US006889434B2

(12) United States Patent
Hernandez et al.

(10) Patent No.: US 6,889,434 B2
(45) Date of Patent: May 10, 2005

(54) METHOD OF ASSEMBLING A BOBBIN

(75) Inventors: Cecilia Hernandez, Chihuahua (MX); Miguel Antonio Maldonado, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 226 days.

(21) Appl. No.: 10/375,317

(22) Filed: Feb. 26, 2003

(65) Prior Publication Data

US 2004/0163249 A1 Aug. 26, 2004

(51) Int. Cl.[7] ..... H01R 43/02
(52) U.S. Cl. ..... 29/860; 29/857; 29/592.1
(58) Field of Search ..... 29/825, 592.1, 29/857, 860

(56) References Cited

U.S. PATENT DOCUMENTS 4,701,735 A * 10/1987 Hill et al. ..... 335/282
5,263,639 A * 11/1993 Lee et al. ..... 228/176
6,124,775 A * 9/2000 Linkner, Jr. ..... 335/278
6,186,421 B1 2/2001 Wahba et al.
6,369,682 B1 4/2002 Thompson, Jr. et al.
6,498,558 B1 * 12/2002 Linker et al. ..... 336/208

* cited by examiner

*Primary Examiner*—Carl J. Arbes
(74) *Attorney, Agent, or Firm*—Jimmy L. Funke

(57) ABSTRACT

A method for assembling an electrical bobbin requires a spool of wire extending between first and second leads, a housing having first and second opening, and first and second terminal posts, each having a predetermined width. The method includes the step of placing the spool of wire into the housing. The first lead is then extended through the first opening. Like the first lead, the second lead is then extended through the second opening. The first terminal post is extended into the first opening and the second terminal post is extended into the second opening. The first lead is wrapped around the first terminal post to create a first wire wrap. The second lead is wrapped around the second terminal post to create a second wire wrap. The first wire wrap is soldered to the first terminal post. The second wire wrap is soldered to the second terminal post. Each of the first and second terminal posts are moved further into the first and second opening to reduce the amount of first and second terminal posts extending out of the housing.

4 Claims, 2 Drawing Sheets

METHOD OF ASSEMBLING A BOBBIN

BACKGROUND ART

1. Field of the Invention

The invention relates to a method for assembling an electrical bobbin. More particularly, the invention relates to a method for assembling a bobbin designed to be mounted in spaces that are limited in size.

2. Description of the Related Art

Bobbins are important electrical components that are used throughout many mechanical environments. The bobbins may be used as part of the solenoid or an inductor. The terminals of the bobbins are important components thereof. The terminals are the components that interface between the bobbin and the connector to the rest of the electrical circuit.

Design protocol and bobbin design dictates the shape of the terminals. The height of the terminals is an important factor in the component design of the bobbin. Conflicting requirements include the desire to have a large height for purposes of effectively soldering the leads of the bobbin to the terminals juxtaposed the desire to have the terminal posts reduced in size allowing the bobbin to be placed in a location that has limited space. Therefore, there is a need to effectively design terminal posts designed to maximize both subsequent manufacturing processes and the requirements to place the bobbins in smaller spaces.

SUMMARY OF THE INVENTION

A method for assembling an electrical bobbin requires a spool of wire extending between first and second leads, a housing having first and second openings, and first and second terminal posts, each having a predetermined width. The method includes the step of placing the spool of wire into the housing. The first lead is then extended through the first opening. Like the first lead, the second lead is then extended through the second opening. The first terminal post is extended into the first opening and the second terminal post is extended into the second opening. The first lead is wrapped around the first terminal post to create a first wire wrap. The second lead is wrapped around the second terminal post to create a second wire wrap. The first wire wrap is soldered to the first terminal post. The second wire wrap is soldered to the second terminal post. Each of the first and second terminal posts are moved further into the first and second openings to reduce the amount of first and second terminal posts extending out of the housing.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 3:
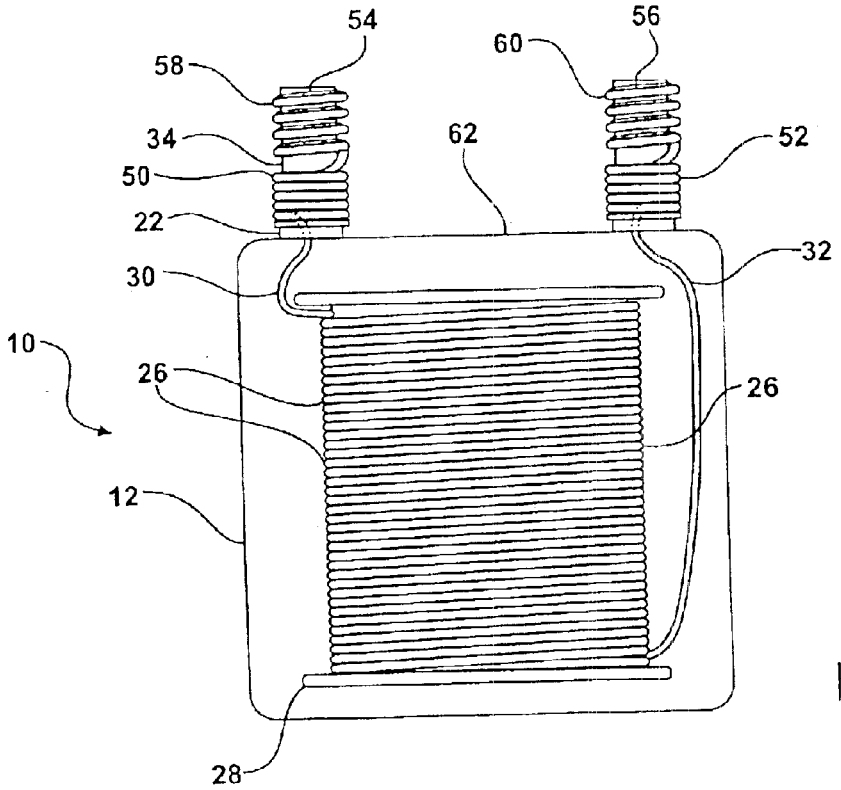
FIG. 3 is a side view of a bobbin assembly having been manufactured according to the method.

Referring to FIG. 3, a bobbin assembly is generally indicated at 10. The bobbin is an electrical bobbin 10 and may be used for a plurality of functions. A non-exhaustive list of uses for the bobbin assembly 10 include solenoid actuators, inductors, and the like. The bobbin assembly 10 includes a housing 12. The housing 12 includes a first 14 and second 16 openings. As may be best seen in FIGS. 4 and 5, first 18 and second 20 sleeves, having first 22 and second 24 collars, extend down into the first 14 and second 16 openings.

Returning attention to FIG. 3, the bobbin assembly 10 includes a spool of wire 26 that extends around a spool 28. A spool of wire 26 extends between a first lead 30 and a second lead 32. The leads 30, 32 extend around first 34 and second 36 terminal posts. The terminal posts 34, 36 have a predetermined width and extend between exposed end 38, 40 and slotted ends 42, 44. Each of the slotted ends 42, 44 include a slot 46, 48 that extends through the terminal posts 34, 36. The slots 46, 48 will be discussed in greater detail subsequently.

The first 30 and second 32 leads are wrapped around the exposed ends 38, 40 of the first 34 and second 36 terminal posts. The wrappings of the leads 30, 32 create a first wire wrap 50 and a second wire wrap 52. A portion of the wire wraps 50, 52 are soldered using solder 54, 56. In the embodiment shown, upper portions 58, 60 of the wire wraps 50, 52 are soldered.

The method for assembling the bobbin assembly 10 includes the step of placing the spool of wire 26 into the housing 12. The first 30 and second 32 leads are extended through the first 14 and second 16 openings, respectively. The leads 30, 32 are then wrapped around the terminal posts 34, 36 to create the first 50 and second 52 wire wraps. As may be seen with respect to the second terminal post 36 in FIGS. 1, 2 and 4, which is the state of both terminal posts 34, 36 during some period in the manufacturing process of the bobbin assembly 10, the wire wrap 52 is initially wrapped around the second terminal post 36 loosely. More specifically, there is space between each of the individual wraps that make the entire wire wrap 52.

Figure 1:
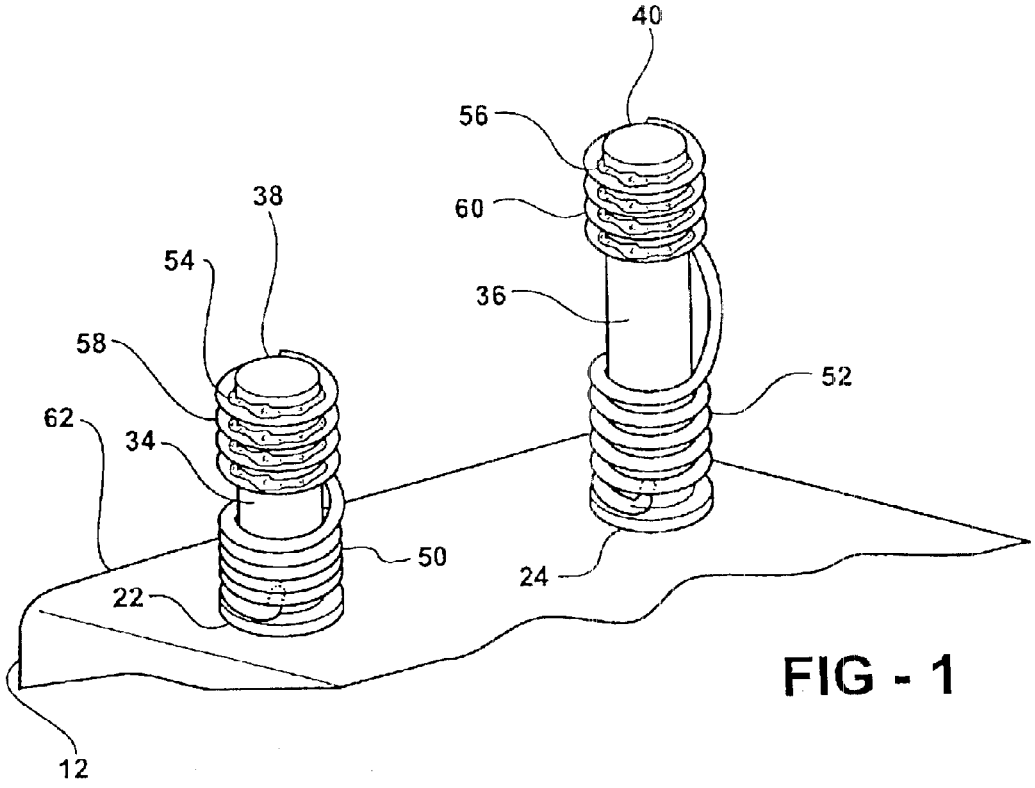
FIG. 1 is a perspective view, partially cut-away, of a bobbin assembly in the process of being manufactured according to the inventive method.
Figure 2:
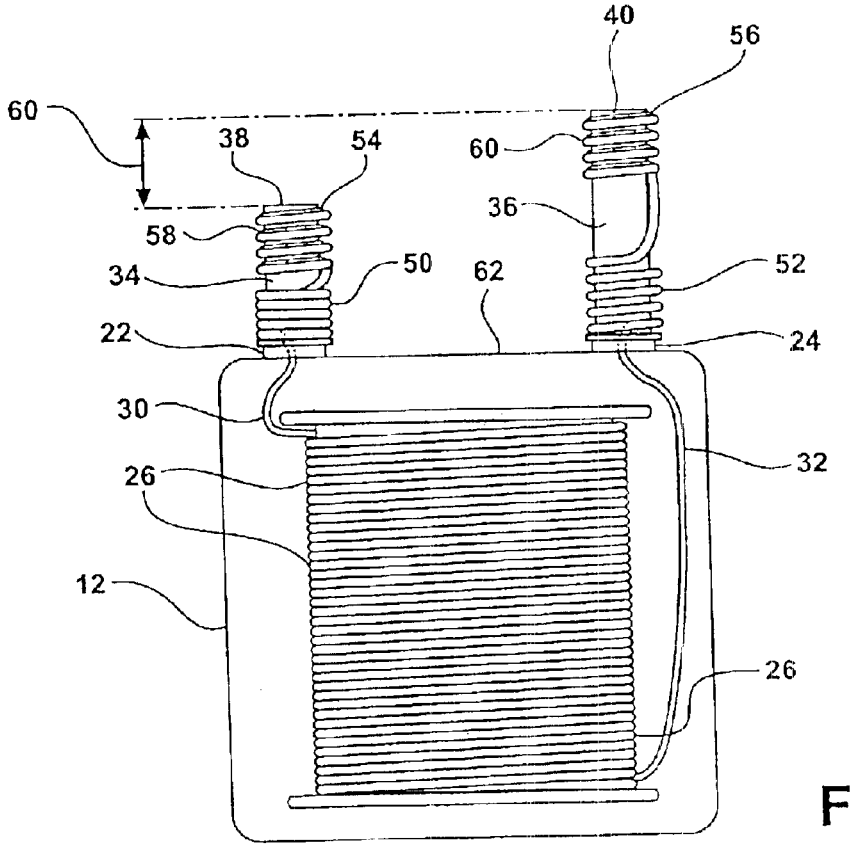
FIG. 2 is a side view of a bobbin assembly in the process of being manufactured.
Figure 4:
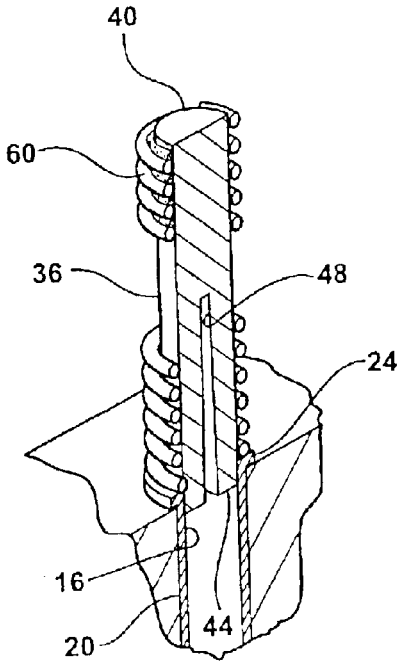
FIG. 4 is a perspective view partially cut-away of a terminal post during the process of manufacturing the bobbin assembly.
Figure 5:
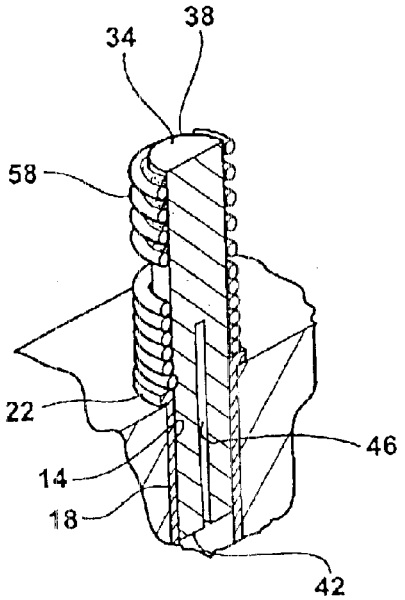
FIG. 5 is a perspective view, partially cut-away, of a terminal post inserted into a housing of a bobbin assembly after the completion of the method.

At this point, the first 34 and second 36 terminal posts extend out of the housing 12 above a top housing surface 62 a distance that is reflected in the depiction of the second terminal post 36. Because each of the terminal posts 34, 36 extend out the same distance as that of the second terminal post 36, as it is depicted in FIGS. 1, 2 and 4, the step of applying the solder 54, 56 onto the wire wraps 50, 52 is done at a time when the upper portions 58, 60 are further from the top housing surface 62. This allows the step of soldering to be done in an accurate fashion because there is more room in which to operate.

Once the first 30 and second 32 leads are soldered to the first 34 and second 36 terminal posts, the terminal posts 34, 36 are moved further into the first 14 and second 16 openings to reduce the amount of the first 34 and second 36 terminal posts that are extending out of the housing 12 above the top housing surface 58. Referring to FIG. 2, it is shown that the first terminal post 34 is moved into the first opening 14 which reduces the overall length of the first terminal post 34 extending out of the housing 12 by distance 60, as compared with the second terminal post 36 which is shown yet to be moved further into the second opening 16.

By moving the first 34 and second 36 terminal posts further into the housing 12, the method also compresses the terminal posts 34, 36 by forcing the terminal posts 34, 36 into the sleeves 18, 20. The compression of the terminal posts 34, 36 is provided by the slots 46, 48 that extend up through the slotted ends 42, 44 thereof.

In addition, the portions of the wire wraps 50, 52 that have not been soldered are compressed with respect to the individual wraps once the terminal posts 34, 36 are moved further into the housing 12, as depicted in FIG. 3. The ability for the wire wraps 50, 52 to move along the terminal posts 34, 36 eliminates stress on the solder 54, 56 by not requiring the upper portions 58, 60 of the wire wraps 50, 52 to move with respect to the terminal posts 34, 36.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

What is claimed:

1. A method for assembling an electrical bobbin having a spool of wire extending between first and second leads, a housing having first and second openings, and first and second terminal posts, each having a predetermined width, the method comprising the steps of:

placing the spool of wire into the housing;

extending the first lead through the first opening and the second lead through the second opening;

inserting the first terminal post into the first opening and the second terminal post into the second opening;

wrapping the first lead around the first terminal post to create a first wire wrap and the second lead around the second terminal post to create a second wire wrap;

soldering the first wire wrap to the first terminal post;

soldering the second wire wrap to the second terminal post; and moving the first and second terminal posts further into the first and second openings to reduce the amount of the first and second terminal posts extending out of the housing.

2. A method as set forth in claim 1 including the step of compressing the first and second terminal posts during the step of moving the first and second terminal posts further into the housing.

3. A method as set forth in claim 2 wherein the steps of wrapping the first and second leads include the step of wrapping the first and second leads a predetermined number of windings.

4. A method as set forth in claim 3 wherein the step of soldering includes the step of soldering a portion of the first and second wire wraps.

* * * * *